US005746532A

United States Patent [19]

Megill et al.

[11] Patent Number: 5,746,532

[45] Date of Patent: May 5, 1998

[54] TOOTHBRUSH ASSEMBLY

[76] Inventors: Joseph M. Megill; John T. Megill, both of 7362 Wissinoming St., Philadelphia, Pa. 19136

[21] Appl. No.: 724,313

[22] Filed: Oct. 1, 1996

[51] Int. Cl.[6] ..... A46B 11/02

[52] U.S. Cl. ..... 401/175; 401/269; 401/271

[58] Field of Search ..... 401/175, 123, 401/271, 269

[56] References Cited

U.S. PATENT DOCUMENTS

| | | | |
|---|---|---|---|
| 1,336,390 | 4/1920 | Sargery et al. . | |
| 1,340,115 | 5/1920 | Breining . | |
| 1,451,941 | 4/1923 | Clum | 401/175 |
| 1,578,922 | 3/1926 | Sargery . | |
| 1,642,620 | 9/1927 | Merrill | 401/123 X |
| 1,711,183 | 4/1929 | Smith | 401/175 |
| 1,902,859 | 3/1933 | Joseph . | |
| 2,146,847 | 2/1939 | Poole et al. | 401/175 X |
| 2,908,925 | 10/1959 | Reitknecht | 401/175 |
| 2,986,766 | 6/1961 | Landis . | |
| 2,997,078 | 8/1961 | Gainer . | |
| 3,995,648 | 12/1976 | Kuryla | 401/175 X |
| 4,013,370 | 3/1977 | Gingras | 401/175 |
| 4,135,831 | 1/1979 | Reitknecht . | |
| 4,655,627 | 4/1987 | Bradley . | |
| 4,957,125 | 9/1990 | Yaneza . | |

FOREIGN PATENT DOCUMENTS

| | | | |
|---|---|---|---|
| 594479 | 3/1934 | Germany | 401/175 |
| 643983 | 8/1962 | Italy | 401/175 |
| 219036 | 1/1942 | Switzerland | 401/175 |
| 434188 | 10/1967 | Switzerland | 401/175 |

*Primary Examiner*—Steven A. Bratlie
*Attorney, Agent, or Firm*—Eugene E. Renz, Jr.

[57] ABSTRACT

A toothbrush assembly comprising an elongated hollow handle defining a chamber for a cartridge filled with toothpaste, a brush head assembly detachably mounted at one end of the handle having a series of flexible valves, an actuator assembly mounted at the opposite open end of the handle including a piston engagable with a rear seal of the cartridge and actuatable axially in the cartridge to displace toothpaste through a channel in the brush head assembly and through the series of valves in the brush head which open to permit release of toothpaste and close automatically to a closed position when piston advance is stopped.

2 Claims, 4 Drawing Sheets

TOOTHBRUSH ASSEMBLY

The present invention relates to a toothbrush assembly, and more specifically to improvements in assemblies of the type having a replaceable cartridge for a supply of toothpaste.

BACKGROUND OF THE INVENTION

Toothbrush assemblies of the type to which the present invention relate are not new per se. For example, the patents listed below show toothbrush assemblies comprising an elongated handle having a chamber for a supply of toothpaste and means for dispensing premeasured amounts of the toothpaste from the chamber to the bristles of the brush.

U.S. Pat. No. : 1,336,390
Title: Fountain Toothbrush
Inventor: J. A. Sargery and O. DuPont
Issued Date: Apr. 6, 1920
U.S. Pat. No. : 1,340,115
Title: Fountain Toothbrush
Inventor: C. P. Breining
Issued Date: May 11, 1920
U.S. Pat. No. : 1,451,941
Title: Toothbrush and Paste Holder
Inventor: F. H. Clum
Issued Date: Apr. 17, 1923
U.S. Pat. No. : 1,578,922
Title: Fountain Toothbrush
Inventor: J. A. Sargery
Issued Date: Mar. 30, 1926
U.S. Pat. No. : 1,902,859
Title: Fountain Toothbrush
Inventor: R. J. Joseph
Issued Date: Mar. 28, 1933
U.S. Pat. No. : 2,986,766
Title: Fountain Brushes
Inventor: P. H. Landis
Issued Date: Jun. 6, 1961
U.S. Pat. No. : 2,997,078
Title: Fountain Toothbrush
Inventor: W. Gainer
Issued Date: Aug. 22, 1961
U.S. Pat. No. : 4,135,831
Title: Laminated Fountain Toothbrush with Barrier
Inventor: Jack Reitknecht
Issued Date: Jan. 23, 1979
U.S. Pat. No. : 4,655,627
Title: Brush with Self-Sealing Reservoir Having A Convertible Actuator
Inventor: George C. Bradley
Issued Date: Apr. 7, 1987
U.S. Pat. No. : 4,957,125
Title: Toothbrushing Assembly
Inventor: Merle L. Yaneza
Issued Date: Sep. 18, 1990

SUMMARY OF THE INVENTION

The present invention relates to an improved toothbrush assembly which is characterized by the novel features of construction and arrangement providing certain advantages over the prior art assemblies disclosed in the patents listed above. Generally, the improvements provide for a more economical, more easily assembled unit and one which is hygienically superior to various of the assemblies shown in the prior art patents. More specifically, in the present invention, the brush head is equipped with plurality of slit valve assemblies which is of simplified construction and comprises resilient or flexible valve elements which normally are in a closed position and which will open to release a supply of toothpaste to the bristles for a toothbrushing. This arrangement contrasts with the rather complex valve systems, such as shown in the Bradley U.S. Pat. No. 4,655,627. It is been found that the toothpaste tends to cause valve malfunctions of the type shown in the prior art. Reitknecht U.S. Pat. No. 4,135,831 also shows a complex assembly which needs manual manipulation to position the valve between open and close positions. Sargery U.S. Pat. No. 1,578,922 is also a rather complex valve which needs manual operation and is not automatic. Further, a part of the valve element protrudes in the bristles and may cause injury to a user.

In accordance with another feature of the present invention, the brush head is detachably mounted in the handle in a rather simple, snap fit fashion which provides an effect seal and is relatively easy to clean and maintain in a trouble free way. Specifically, the brush head comprises a truncated cylindrical stem of circular cross section and a transition zone of square cross section having a locking groove which engages in a seat in the discharge end of the handle which complements the shape of the stem and transition zone of the brush head. The seat includes a detent which snap fits in the groove in the brush head to hold the brush head firmly in place in a sealed position to prevent leakage of toothpaste when the assembly is in use. Various of the patents listed above show a threaded connection between the bristle part of the assembly and the handle. It has been found that the assembly of the present invention provides a better seal and is more economical to manufacture, and easier and quicker to use.

In accordance with another feature of the present invention, the actuator assembly includes an actuator knob and a piston and wherein the seal for the cartridge forms part of the piston assembly for displacing the toothpaste upon actuation of the actuator knob. The specific mounting of the actuator includes a retaining ring and an end cap which facilitate easy assembly of the actuator in the handle, and provides a bearing and support surface permitting free wheeling of the actuator knob, thereby providing ease of use for even aged or handicapped people. In this fashion, the actuator piston does not contact the toothpaste and therefore, does not require cleaning of the assembly when changing cartridges since the actuator piston never contacts the toothpaste directly.

In summary, the present invention provides a novel improvement in this art and a toothbrush assembly which has a highly pleasing appearance, one which is easy and economical to manufacture, and one which minimizes some of the disadvantages in use of the prior art discussed above.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENT

Figure 6:
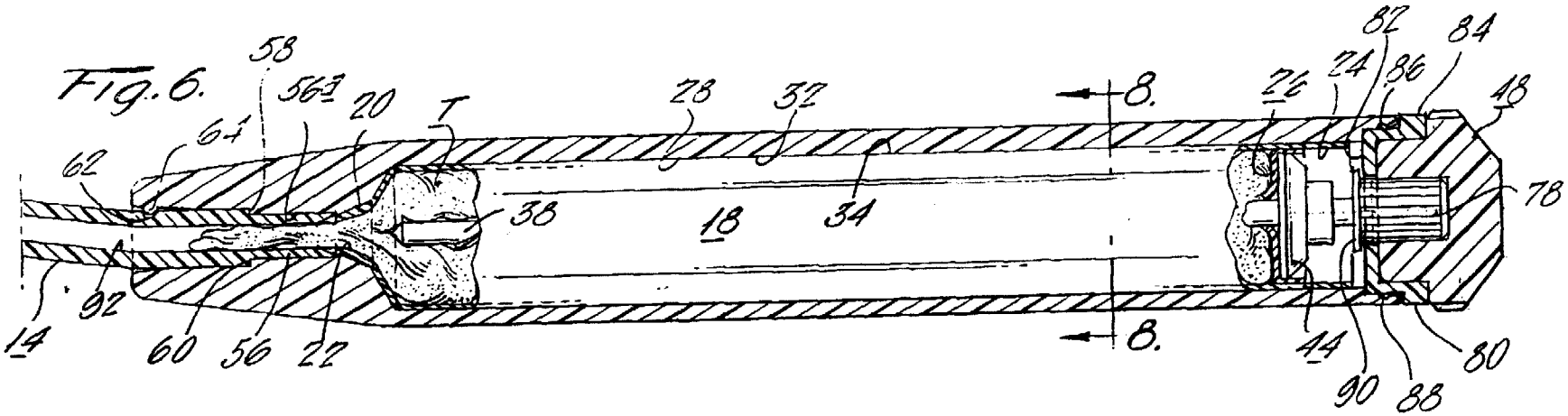
FIG. 6 is an enlarged fragmentary sectional view showing details of the cartridge filled cavity of the toothbrush handle, the piston being shown in a slightly advanced position driving the pierceable end cap of the cartridge against the toothbrush contents of the cartridge causing the toothpaste to flow into the internal channel of the brush head.
Figure 7:
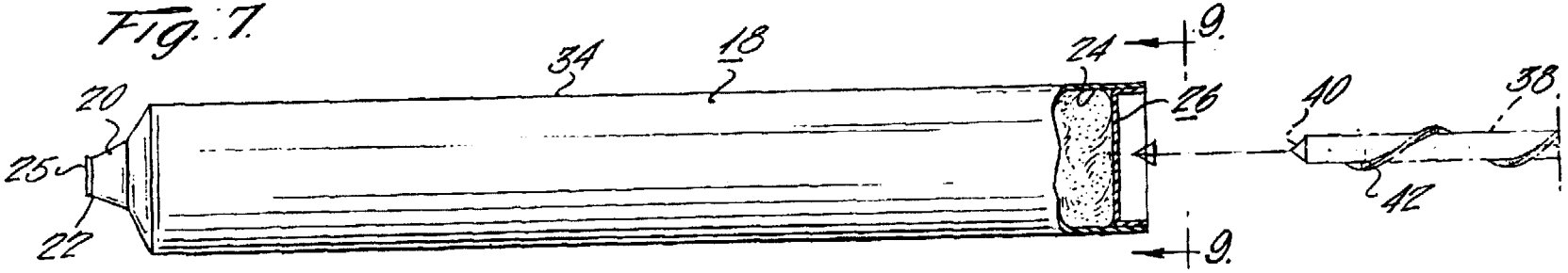
FIG. 7 is a side elevational view of the toothpaste cartridge with the capped end broken open and in section, shown fragmentarily in dot and dash line an end portion of the lead screw prior to piercing the end cap of the cartridge.
Figure 9:
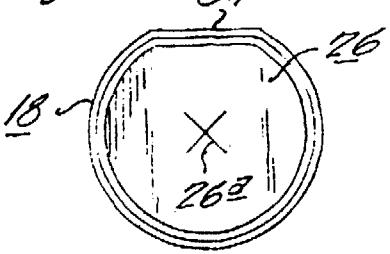
FIG. 9 is an end elevational view of the cartridge taken on lines 9—9 of FIG. 7.
Figure 8:
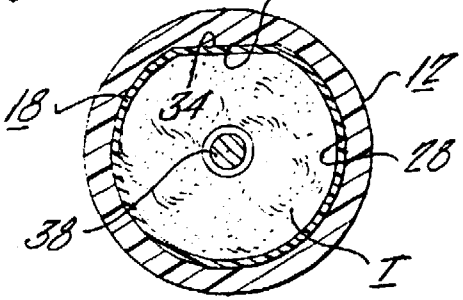
FIG. 8 is an enlarged transverse sectional view taken on lines 8—8 of FIG. 6 showing additional details of the cartridge handle.

Referring now to the drawings, and particularly to FIGS. 1–12 thereof, there is illustrated a toothbrush assembly constructed in accordance with the present invention. As illustrated therein, the assembly, which is generally designated by the numeral 10 comprises an elongated generally cylindrical handle (12), a brush head (14) detachably mounted at one end of the handle (12) having the usual set of bristles (16). The handle (12) is hollow defining a chamber (28) to house a cartridge (18) for a supply of toothpaste. The cartridge as best illustrated in FIG. 7 has a nozzle (20) at one end defining a discharge port (22) and is open at its rear end as at (24). The discharge port (22) and open rear end (24) of the cartridge (18) are normally sealed. The front seal comprises a peel-off seal (25) and the rear seal is in the form of a cap seal (26) which is puncturable to accommodate the lead screw of a toothpaste actuator generally designated A. The cap seal (26) is partially scored, in the presence instance, an X score 26A to make the cap seal more easily puncturable when it is desired to activate the assembly in the manner described in more detail below. The chamber (28) is of a non circular cross section and the cartridge is of a cross section conforming to the cross section of the chamber (28) so that when the cartridge is inserted therein, it does not rotate relative to the handle. In the presence instance, the chamber (28) is of generally circular cross section and has a short segmental chord defining a longitudinal extending flat (32). The cartridge likewise has a segmental cord defining a longitudinal extending flat (34).

Figures 1, 2, 3, 4, 5:
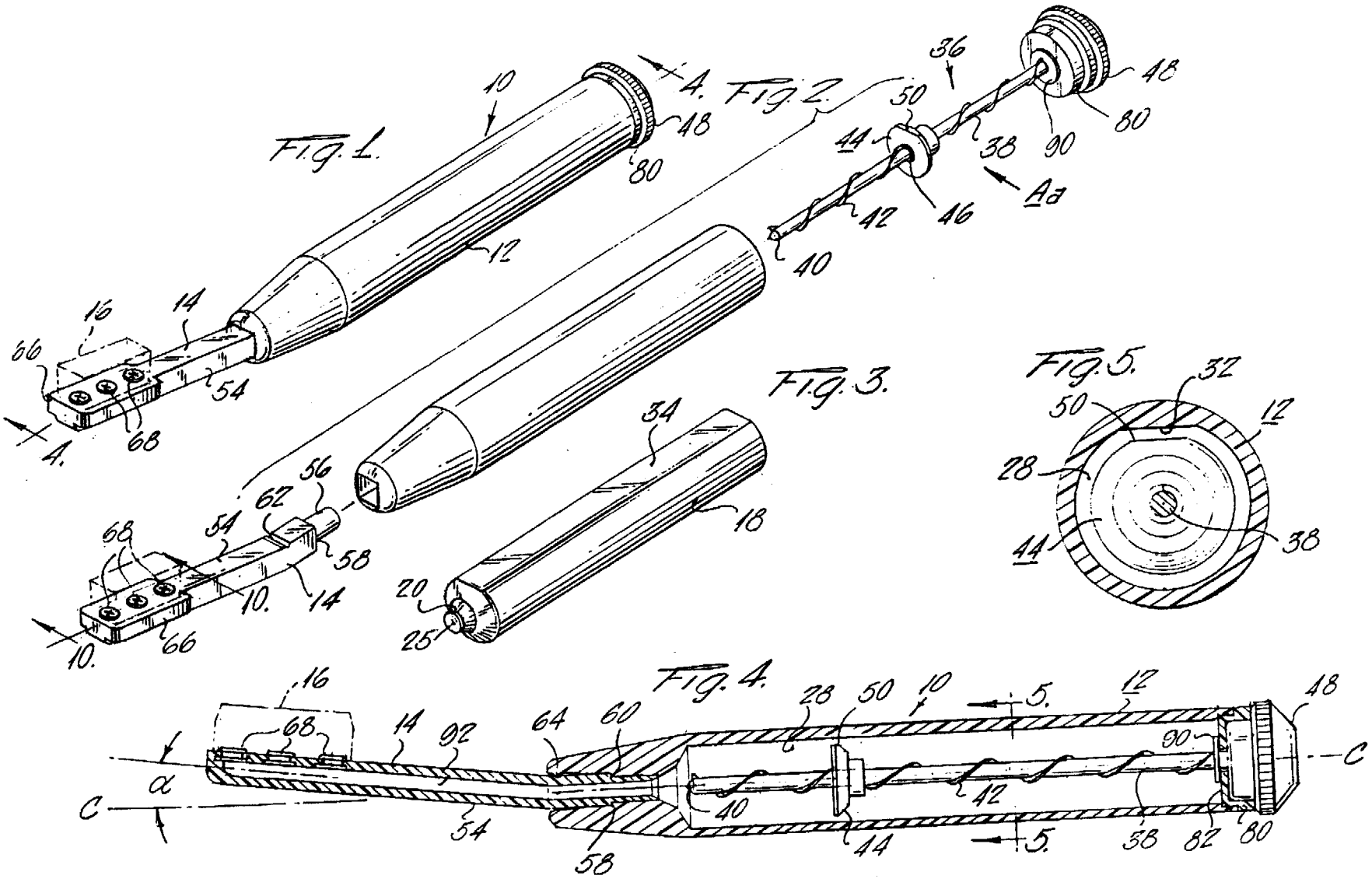
FIG. 1 is an isometric view of a toothbrush assembly for dispensing desired quantities of toothpaste to the brush head bristles, constructed in accordance with the invention.
FIG. 2 is an exploded isometric view showing the detachable components comprising the toothbrush assembly shown in FIG. 1.
FIG. 3 is an isometric view showing details of a toothpaste refill cartridge.
FIG. 4 is an enlarged sectional view taken on lines 4—4 of FIG. 1, showing details of the assembly prior to loading the toothpaste cartridge.
FIG. 5 is an enlarged transverse sectional view taken on lines 5—5 of FIG. 4 showing details of the shape of the handle cavity and the screw driven piston.

The actuator (36) as illustrated in FIG. 2, comprises an elongated rod (38) having a piercing tip (40) and helical thread (42) spirally extending along the length of the rod (38) for its entire length. The actuator (36) includes a piston (44) having a threaded bore (46) and an actuator knob (48) fixedly connected to the rod (38) so that turning of knob (48) effects axial movement of the piston (44) along the helical thread (42). The piston is of generally circular cross section and has a flat (50) complementing the chordal surface (34) of the cartridge so that rotation of the knob (48) produces axial movement of the piston in the cartridge.

Considering now briefly use of the toothbrush assembly of the present invention. The user simply attaches the brush head (14) to the front end of the handle (12). The front peel off seal (25) of the cartridge (18) is then removed and the cartridge (18) inserted in the chamber (28) of the handle. The piston (44) of the actuator assembly is then positioned closely adjacent the actuator knob (48) [see FIGS. 4, 6] and the actuator assembly is assemble to the handle (12). More specifically the piercing tip (40) of the rod (38) is then aligned with the X score (26A) in the cap seal (26) and moved axially to penetrate the same. The actuator assembly is then fully displaced into the cartridge until the face of the piston (44) confronts and lays adjacent the cap seal (26) of the cartridge. Now when it is desired to feed a quantity of toothpaste to the bristles, the knob (48) is simply rotated in a clockwise direction which advances the piston (44) forwardly in the manner shown in FIG. 6 and initiates flow of toothpaste T through the discharge nozzle of the cartridge and into the central channel of the brush head. Toothpaste T flows from the central channel through valves I in the brush head into the space between the rows B of bristles in the manner shown in FIG. 10.

Considering now the components of the assembly in more specific detail and considering first the specific details of the brush head (14), the brush head (14) comprises an elongated body portion (54), a cylindrical stem (56) at its inner end remote from the bristles (16) which projects from the main body portion and forms a transitional section with the main body portion of square cross section as at 58. The transition (58) and circular stem (56) engage in a complementary seat in the front end of the handle (12) which limits inward penetration of the detachable brush head, the circular stem (56) and square transition (58) forming a step at their juncture.

Figure 11:
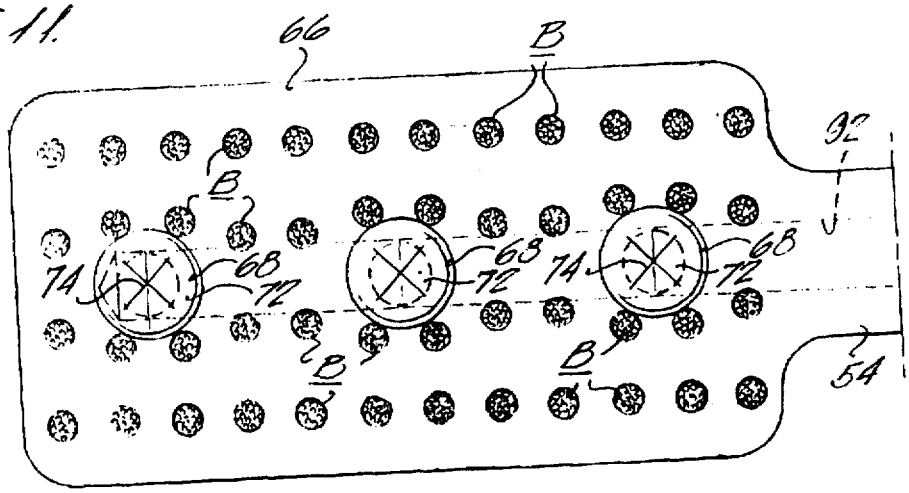
FIG. 11 is a sectional plan view taken on lines 11—11 of FIG. 10.
Figure 10:
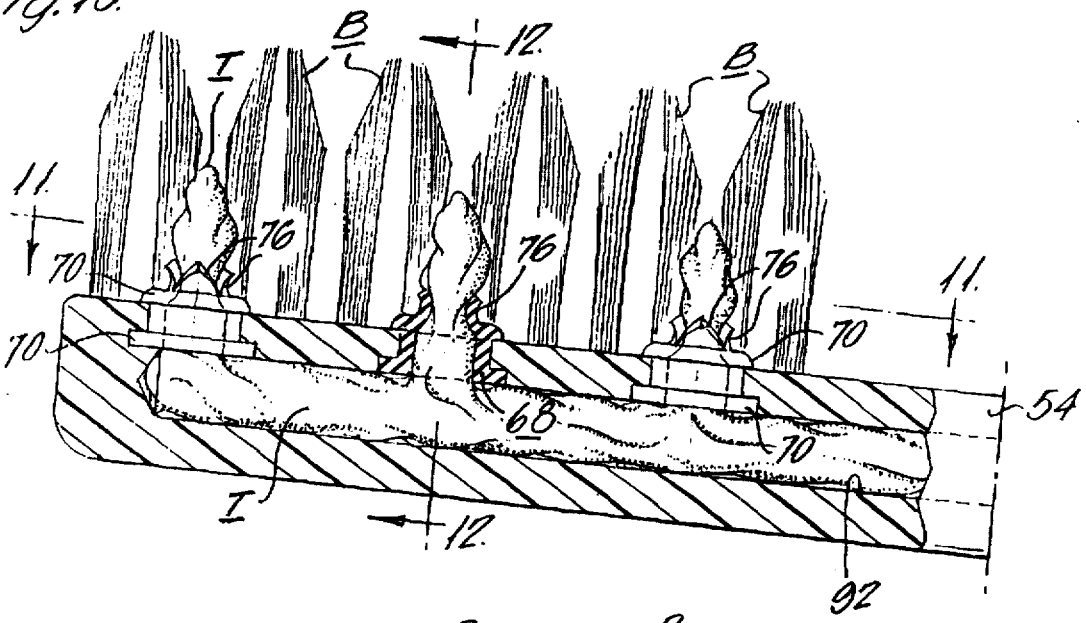
FIG. 10 is a greatly enlarged fragmentary sectional view taken on lines 10—10 of FIG. 2, showing details of the bristle end of the brush holder including the three slit valves in an opened mode during toothpaste flow.
Figure 12:
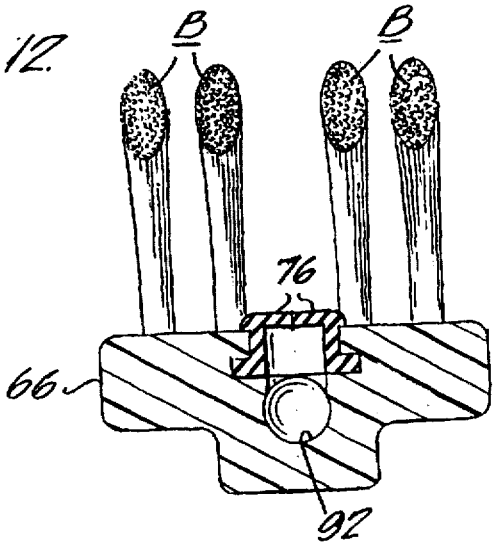
FIG. 12 is a transverse sectional view taken on lines 12—12 of FIG. 10 with the toothpaste removed from central chamber and valve.

A notch (62) located slightly forward of the transition zone defines a locking groove, which cooperates with a detent (64) on the seat formed in the handle for locking the brush head in place. The body portion of the brush head (14) is inclined at a slight angle $\alpha$ in the range of about seven-ten degrees (7°–10°) relative to a longitudinal axis B—B of the handle (12). The body portion of the brush head (14) has an enlarged bristle support pad (16) at one end having series of holes mounting slit valves (68) controlling flow which as illustrated in FIG. 10 are located along the axis B—B of the central channel and disposed between the rows R of bristles as shown in FIGS. 11 and 12. In the present instance, the slit valves (68) are discrete elements. However it is, to be understood that they may be formed integrally with the brush head. The slit valves as illustrated in FIG. 10 are generally cylindrical having a pair axially spaced circumferentially extending mounting flanges (70) for supporting the valves in place in the brush head in the manner shown. The upper wall of each valve is slit as at (74) in an asterisk (*) pattern to define a plurality of displaceable triangularly shaped valve segments (76) which normally are in a closed position as shown in FIG. 12 and which displace outwardly to release toothpaste in the manner shown in FIG. 10. After use of the brush and proper rinsing, the valve elements (76) return to a closed position as shown in FIG. 12 to prevent crusting of the toothpaste and also provide a more hygienic appearance. It is noted that the desired closing of the valve elements (76) may be aided by turning the actuator knob (68) in a counter clockwise direction which may have the effect of creating a vacuum in the region of the valves to withdraw toothpaste in the region of slit valves inwardly.

The brush head (14) is detachable and therefore offers the flexibility providing the following advantages. After a period of use, if the bristles become worn, the brush head may be replaced with a new one. Further, it may be possible for several people to use the same handle and cartridge and have their own individualized brush head. This may be an advantage in travel situations.

Considering now the handle (12), the cross section of the cavity or chamber (28) is of generally circular as shown in FIG. 5 with a cord (32) defining a flat. The cartridge is of a complementary cross section so that it can only be inserted one way and does not rotate relative to the handle when assembled therein. The forward end of the handle has a seat (58) formed therein which as illustrated in FIG. 4, complements the shape of the cylindrical stem and transition of the brush head (14) and comprises a first section (56*a*) of a circular cross section and of a smaller diameter D than the chamber diameter D and an outer section (56*b*) of square cross section. The chamber terminates in a seat at its forward end which complements the profile of the stem and transition zone of the brush head and the detent is formed near the lead edge of the seat. Accordingly, as best illustrated in FIG. 6, the detent engages in the groove of the brush head when it is fully bottomed in the seat of the handle. It is noted that the transition limits the extent the brush head engages in the handle and the close conformity provides a good seal when the parts are assembled in the manner shown in FIG. 6.

As best illustrated in FIG. 6, the dispensing or actuator knob (48) is pressed fitted in an enlarged knurled end (78) of the actuator rod (48). An end cap (80) mounts the actuator assembly in the handle. The end cap (80) also forms a bearing surface for the knob and includes a circumferentially extending axially directed flange (84) having a radially directed bead (86) which seats in a groove (88) in the interior wall of the housing of the handle. A retaining ring (90) maintains the knob and end cap (80) in the assembled relationship shown in FIG. 2. The piston as shown in FIG. 2 is of a profile to complement and conform to the profile of the cartridge and thus includes a flat (50).

Considering again briefly a more detailed review of the use of a tooth brush assembly in accordance with the present invention, assume that the parts are assembled together in the relationship shown in FIG. 6. The user simply rotates the knob (48) in a clockwise direction which advances the piston (44) axially along the spiral thread (42) of the rod (38) to engage the cap seal (26) of the cartridge. As the cap seal (26) and piston (44) advance forwardly, these form essentially a single piston and toothpaste T is discharged to the brush head assembly and travels through the central channel (92) to the slit valves (68). When the user dispenses the desired quantity of toothpaste in the bristles as shown in FIG. 10, the user simply discontinues rotation of the knob (48) and the tooth brush is armed. After a brushing use, the bristles are placed under a jet of water which removes residual toothpaste from the bristles area including the region of the slit valves to permit them to return to the closed position. The user may choose to rotate the actuator knob in a reverse direction creating a slight vacuum and insuring closing of the slit valves.

Figure 13:
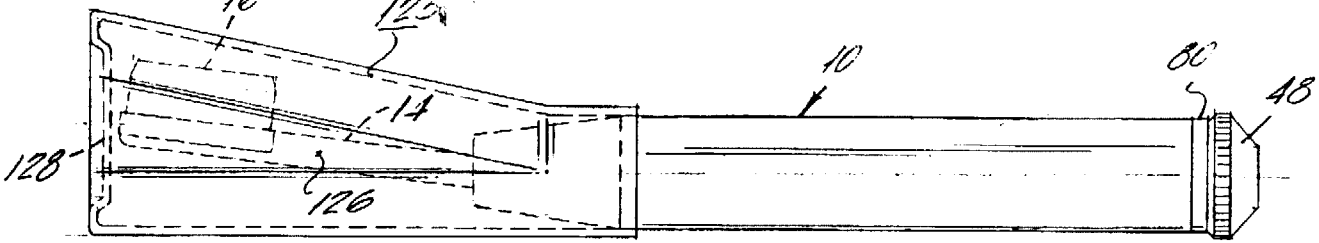
FIG. 13 is a side elevational view of the toothbrush assembly shown in FIG. 1 fitted with a brush head closure.
Figure 15:
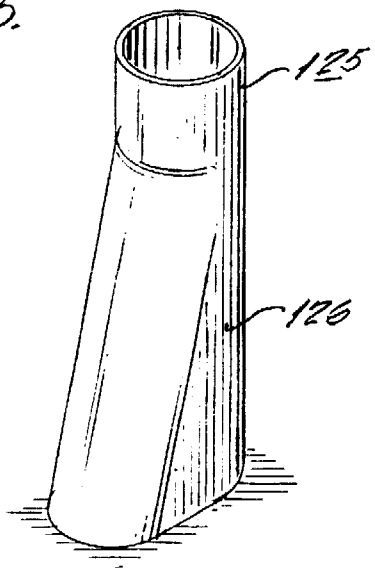
FIG. 15 is an enlarged isometric view of the brush head closure removed from the toothbrush assembly and positioned for use as a rinse cup.
Figure 14:
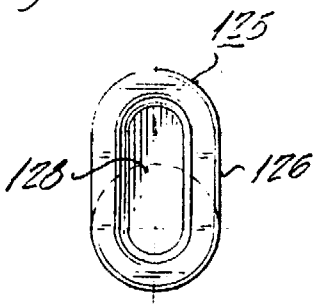
FIG. 14 is a left hand end elevational view of FIG. 13.

As shown in FIGS. 13–15 inclusive, these are shown a cover generally designated by the numeral 125. The cover is used when storing the tooth brush for better hygiene to protect exposure of the bristles to ambient contaminants. It may also function as a rinse cup. The cover as best illustrated FIG. 15 has a generally triangular shape and when applied to the tooth brush assembly supports it in a non-rolling manner on a flat surface. More specifically, the flat sides (126) of the cover provide a stabilizing support for the tooth brush when it is stored on a flat surface such as a shelf in cabinet or the like.

Even though particular embodiments of the present invention have illustrated and described herein, it is not intended to limit the invention and changes or modifications may be made therein within the scope of the following claims.

We claim:

1. A toothbrush assembly comprising;

an elongated hollow handle (12) defining a chamber (28);

a cartridge (18) filled with toothpaste mounted in said chamber (28);

the cross-section of the cartridge (18) and chamber (20) being generally circular and having a short, segmental chord defining a longitudinally extending flat (32) to prevent relative rotation of the cartridge (18) in the chamber (28);

a brush head assembly (14) including bristles (16) on a support pad detachably mounted at one end of the handle;

a plurality of slit valves (68) mounted in openings in said bristle support pad, each valve (68) being generally cylindrically shaped having a pair of axially spaced circumferentially extending mounting flanges (70) for supporting the valves in place, the upper wall of each valve being slit (74) in an predetermined pattern to define a plurality of valve segments (76) which are normally in a closed position located adjacent the base of the bristles;

an actuator assembly (36) mounted at the opposite open end of the handle including a piston (44) actuatable axially in the cartridge to displace toothpaste through a channel (92) in the brush head assembly and through said series of valves (68) in the brush head, said actuator assembly including a rod (38) moveable axially so that having a piercing tip (40) aligned with scoring (26*a*) in the cap seal (26) penetrates the scoring when desired.

2. A toothbrush assembly is claimed in claim 1 including a cover of generally triangular shape which is of a configuration to support the toothbrush assembly in a non-rolling manner on a flat surface when assembled to the brush head assembly.

* * * * *